US005354005A

United States Patent [19]

Mladota

[11] Patent Number: 5,354,005

[45] Date of Patent: Oct. 11, 1994

[54] GRINDING EQUIPMENT FOR A JORDAN REFINER

[75] Inventor: John Mladota, Lausanne, Switzerland

[73] Assignee: Bematec S.A., Lausanne, Switzerland

[21] Appl. No.: 635,114

[22] PCT Filed: May 18, 1990

[86] PCT No.: PCT/EP90/00811

§ 371 Date: Mar. 18, 1991

§ 102(e) Date: Mar. 18, 1991

[87] PCT Pub. No.: WO90/14464

PCT Pub. Date: Nov. 29, 1990

[30] Foreign Application Priority Data

May 19, 1989 [DE] Fed. Rep. of Germany ..... 3916393

[51] Int. Cl.[5] ..... B02C 19/00

[52] U.S. Cl. ..... 241/261.1; 241/293

[58] Field of Search ..... 241/161, 162, 163, 261.1, 241/293, 294

[56] References Cited

U.S. PATENT DOCUMENTS

| | | | |
|---|---|---|---|
| 27,246 | 2/1860 | Sweet | 241/261.1 X |
| 349,332 | 9/1886 | Anderson | 241/293 X |
| 2,651,976 | 9/1953 | Sutherland . | |
| 2,931,586 | 4/1960 | Messing . | |
| 3,452,939 | 7/1969 | Johnson | 241/261.1 |
| 3,614,826 | 10/1971 | Pilao | 241/293 X |

FOREIGN PATENT DOCUMENTS

| | | | |
|---|---|---|---|
| 1461034 | 12/1968 | Fed. Rep. of Germany . | |
| 1466983 | 1/1967 | France . | |
| 2044631 | 10/1980 | United Kingdom | 241/261.1 |

*Primary Examiner*—Mark Rosenbaum
*Attorney, Agent, or Firm*—Sughrue, Mion, Zinn, Macpeak & Seas

[57] ABSTRACT

Grinding equipment for a Jordan refiner for grinding paper pulp having a rotating part in form of a truncated cone and a stationary part in the form of a hollow truncated cone, on which bar-shaped knives are arranged at predetermined angles with respect to the conical shell generating lines. To improve the grinding equipment of the refiner, a pre-grinding zone is arranged upstream of one or more fine grinding zones whose configuration and arrangement are adapted to the state and desired development of the fibers in the grinding stock flowing through the grinding equipment.

14 Claims, 6 Drawing Sheets

GRINDING EQUIPMENT FOR A JORDAN REFINER

Figure 1:
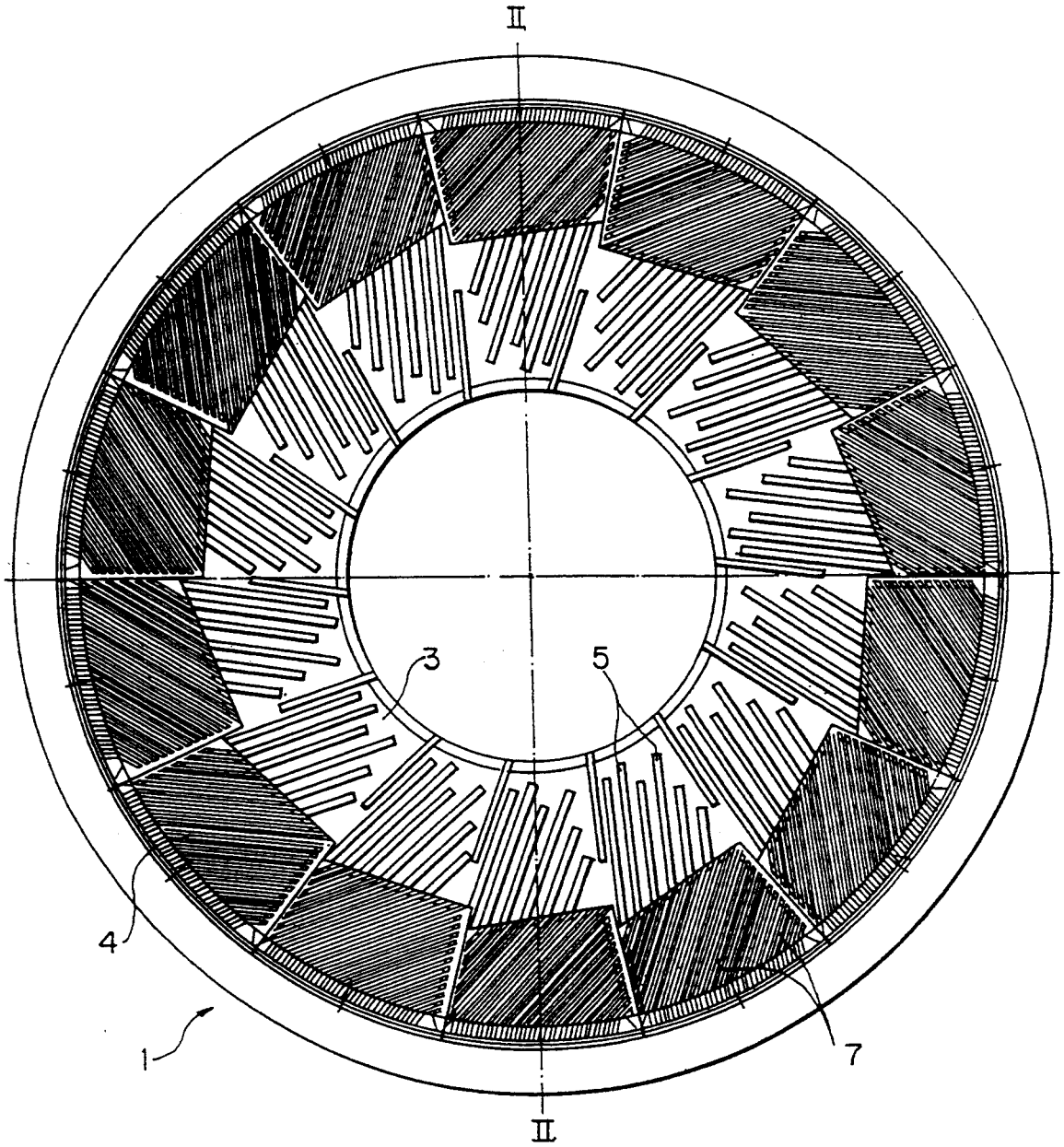

The invention relates to grinding equipment for a Jordan refiner for grinding paper pulp, comprising:

a rotating part in the form of a truncated cone on the outer shell surface of which bar-shaped knives are arranged at predetermined angles with respect to the conical shell generating lines, and a stationary part in the form of a hollow truncated cone on the inner shell surface of which bar-shaped knives are arranged at predetermined angles with respect to the conical shell generating lines.

In known embodiments of such Jordan refiner equipment, the knives are arranged in the rotating as well as the stationary part over the entire grinding surface, i.e. from the inlet to the outlet, formed of the same material, and, at least substantially, with the same arrangement.

From U.S. Pat. No. 2,776,800, a disk refiner comprising an additional suction chamber and air vanes became known in which several grinding zones are provided, although the knives in the pre-grinding zone are not arranged at an angle to the radia and the knives in the further zones are not arranged consecutively at an angle to the radia, but at various positive and negative angles to the radia.

U.S. Pat. No. 2,694,344 shows an extremely steep Jordan refiner comprising an inlet pre-grinding zone and a main grinding zone. In the inlet pre-grinding zone bar-shaped knives are welded or cast in place, namely parallel to the conical shell generating lines or at an angle to these in the stationary part, and with a bend at an angle to the conical shell generating lines as well as parallel to these in the rotating part. In the main grinding zone, the knives are arranged in a fish-bone like manner with the resulting longitudinal axes of the knives approximately parallel to the conical shell generating lines in the stationary part, and are inserted parallel to the conical shell generating lines in the rotating part.

The paper pulp in the form of a fiber suspension of, for example, 5% by weight fibers dissolved in 95% by weight water is fed into the refiner equipment by means of a pump and is processed between the knife edges and the knife surfaces. In the inlet region of the equipment, the knives must be robust and arranged with a relatively wide distance therebetween. The danger of clogging of the equipment can only be safely prevented with such an open inlet.

However, the wide spaces between the knives result in that the cutting edge length per second of the equipment achieves low values, whereby the attainable grinding effect is reduced in an undesirable manner. In previous embodiments of cone-shaped equipment, the parameters required for this inlet zone substantially determine the design of the entire remaining grinding surface.

It is an object of the invention to provide grinding equipment of the type initially described, in particular with regard to the knife arrangement of the refiner, which is substantially independent of the inlet parameters.

This object is solved in accordance with the invention in that a pregrinding zone is arranged upstream of one or more fine grinding zones whose configuration or arrangement are adapted to the respective state and desired development of the fibers in the grinding stock flowing through the grinding equipment, that a pre-grinding zone is arranged upstream of one or more fine grinding zones whose configuration and arrangement are adapted to the respective state and desired development of the fibers of the grinding stock flowing through the grinding equipment, that the bar-shaped knives in the respective zones extend linearly in a planar layout, and that at least in the stationary part, the average angles of the knives to the conical shell lines in the pre-grinding zone amount to at least approximately 10% and in the fine grinding zone to at least approximately 20%.

With this, the transferal of the grinding energy to the fibers can be controlled exactly by means of practically unlimited possibilities of variation of the configurations.

The fine grinding zones differ considerably from the pre-grinding zone, namely with regard to the geometry—width of the knives, width and thickness of the channels between the knives, knife angles with respect to the conical shell generating lines—and also with regard to the knife materials used.

The considerably finer knife structure in the fine grinding zone in comparison to the pre-grinding zone leads on the one hand to a relatively gentle treatment of the grinding stock in the fine grinding zone and on the other hand to a high cutting edge length per second, on account of which the grinding performance increases considerably.

Advantageously, the stationary part has an inner, conical ring-shaped pre-grinding zone and one or more downstream find grinding zones in which the configuration and arrangement of the bar-shaped knives in the pre-grinding zone and the bar-shaped knives or corresponding edge-shaped formations in the fine grinding zone substantially differ from one another.

The configuration and arrangement of the bar-shaped knives substantially depends on the material to be ground. Advantageously, the surface component of the bar-shaped knives of the stationary part in the pre-grinding zone amounts to at most 25 to 30% and in the fine grinding zone to approximately 50%, the depth of the channels between the bar-shaped knives in the pre-grinding zone usefully being substantially greater than the depth of the channels between the bar-shaped knives in the fine grinding zone, these for example, amounting to approximately 20 mm in the pre-grinding zone and approximately 12 mm in the fine grinding zone. In the stationary part, the average angle of the knives with respect to the conical shell generating lines in the pre-grinding zone advantageously amounts to approximately 12° and in the fine grinding zone to approximately 30°.

Usefully, the stationary part is formed as a casting with welded on steel knives in the pre-grinding zone and inserted hard grinding segments in the fine grinding zone. The pre-grinding zone is provided with relatively soft and cheap knives, the fine grinding zone on the other hand having relatively hard, high-quality knives.

Advantageously, the rotating part has a continuous grinding zone.

The surface component of the bar-shaped knives of the rotating part in the grinding zone amounts to approximately 40%, the depth of the channels between the bar-shaped knives of the rotating part being approximately 20 mm.

Advantageously, the average knife angle of the knives of the rotating part with respect to the conical shell generating lines in the region of the pre-grinding zone of the stationary part amounts to approximately 8°, and in the region of the fine grinding zone of the stationary part to approximately 10°.

Thus, with the appropriate knife angle as revealed above of the knives of the stationary part of the grinding equipment in the pre-grinding zone, an average cutting angle between the knives of the stationary and the rotating part of approximately 20° results and of approximately 40° in the fine grinding zone results. The smaller cutting angle causes more cutting, the greater cutting angle more friction in the grinding stock.

The rotating part is also usefully formed with welded-on steel knives.

A further development of the invention consists in that the rotating part has an inner, conical ring-shaped pre-grinding zone and one or more fine grinding zones arranged downstream in which the configuration and the arrangement of the knives in the pre-grinding zone and the bar-shaped knives or corresponding edge-shaped formations in the fine grinding zone differ from one another substantially.

With such a configuration, a further increase in the grinding performance can be achieved.

The configuration and arrangement of the bar-shaped knives of the rotating part in the pre-grinding zone corresponds usefully to that of a rotating part with a continuous grinding zone as previously described.

Advantageously, the rotating part comprising the pre-grinding zone and the fine grinding zone is formed as a casting, with steel knives welded on in the pre-grinding zone and inserted, hard grinding segments in the fine grinding zone.

Generally, the average angle between the knives of the stationary and rotating parts usefully amounts to approximately 20° in the pre-grinding zone and approximately 40° in the fine grinding zone.

The conical opening angle preferably amounts to approximately 60°.

Figure 2:
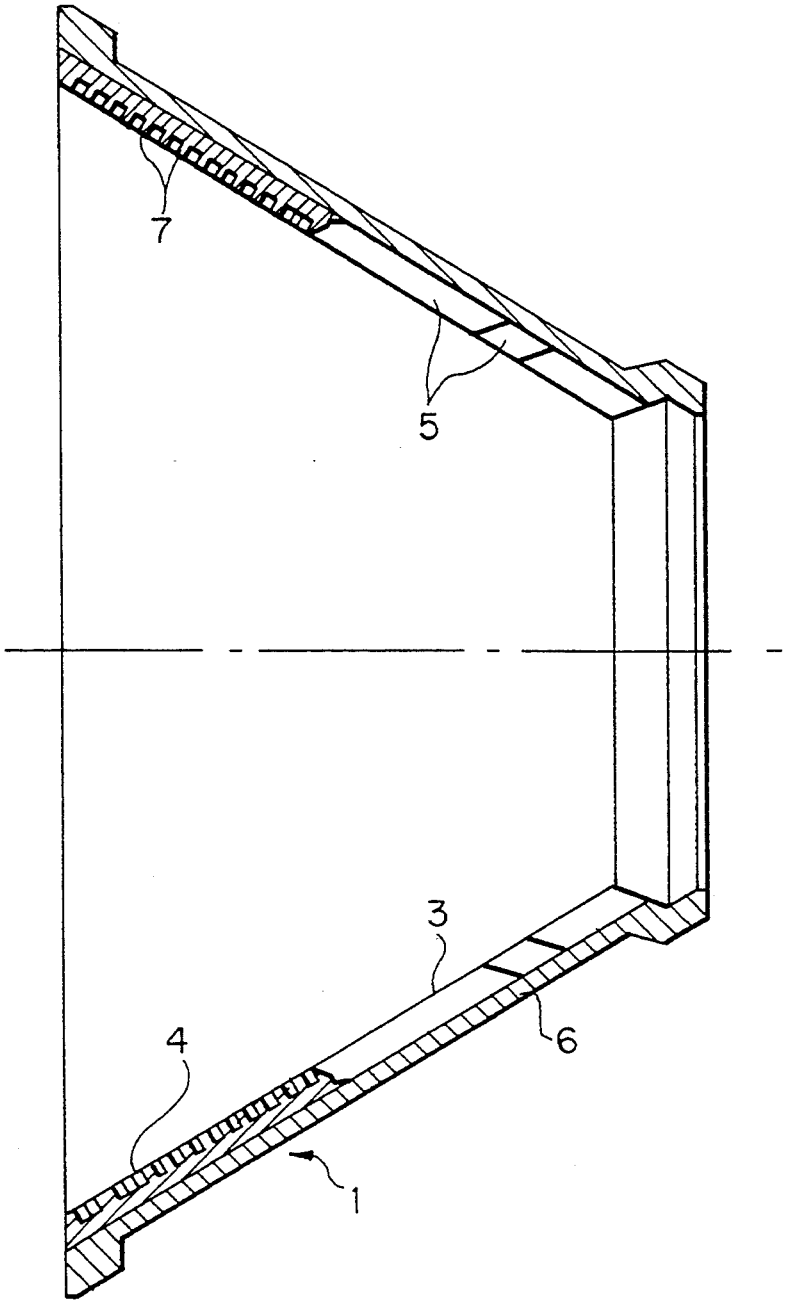
Figure 3:
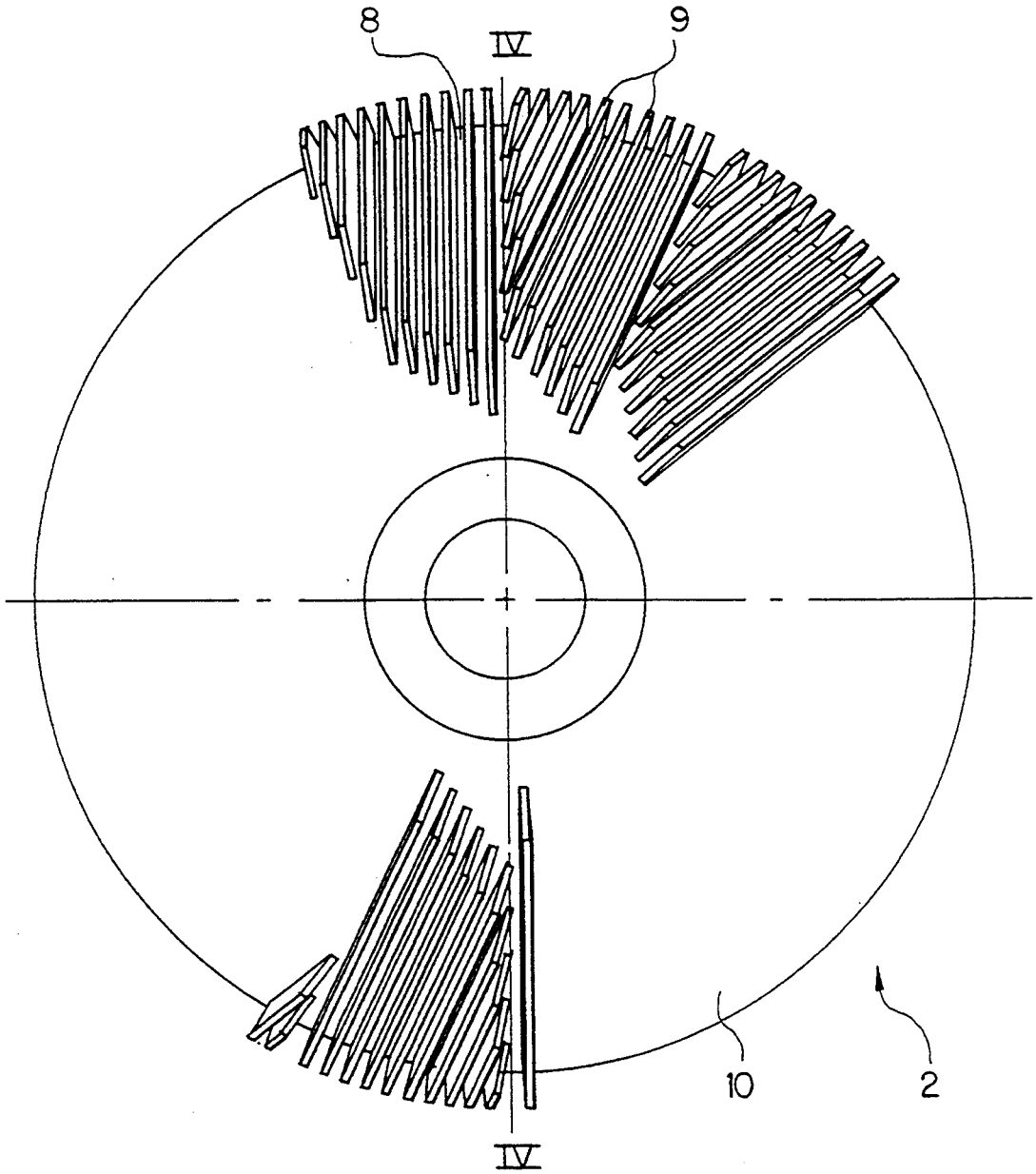
Figure 4:
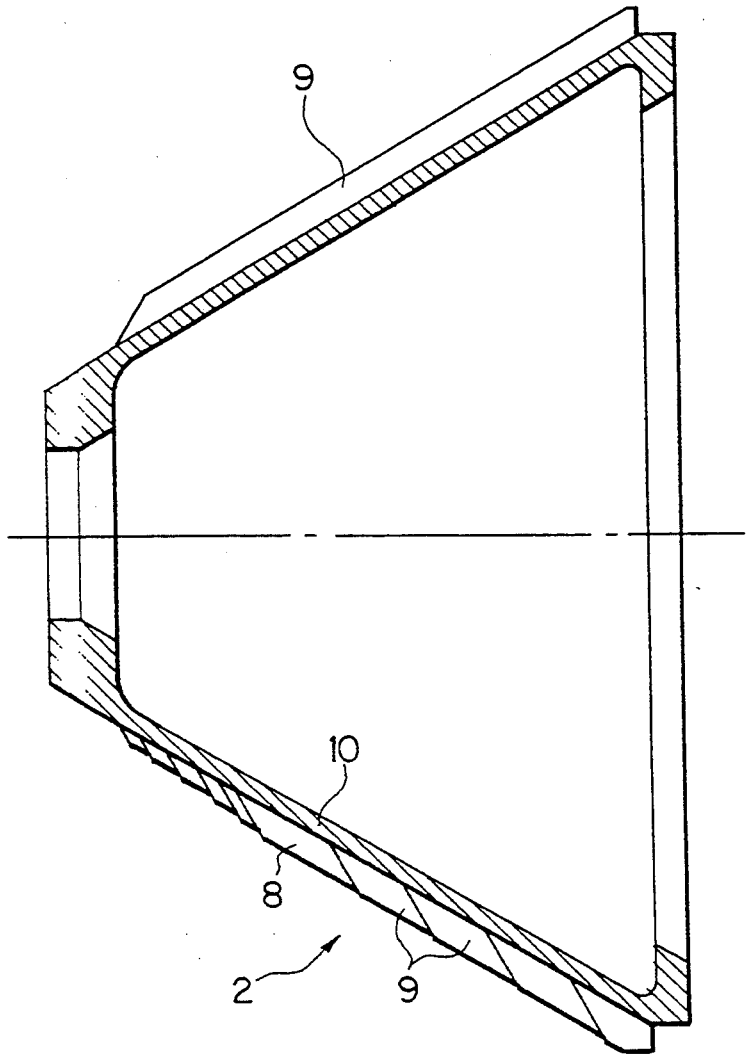
Figure 5:
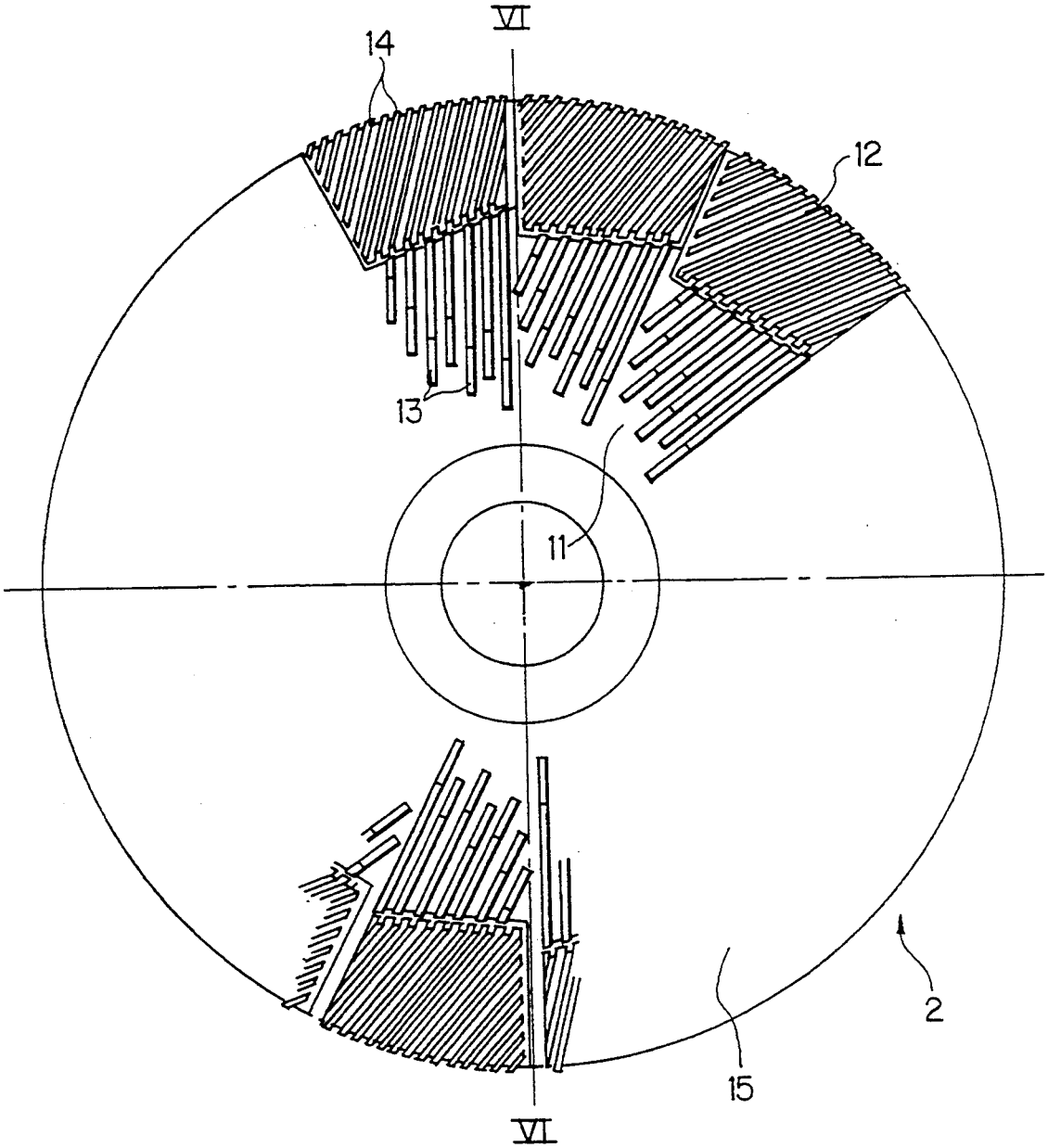
Figure 6:
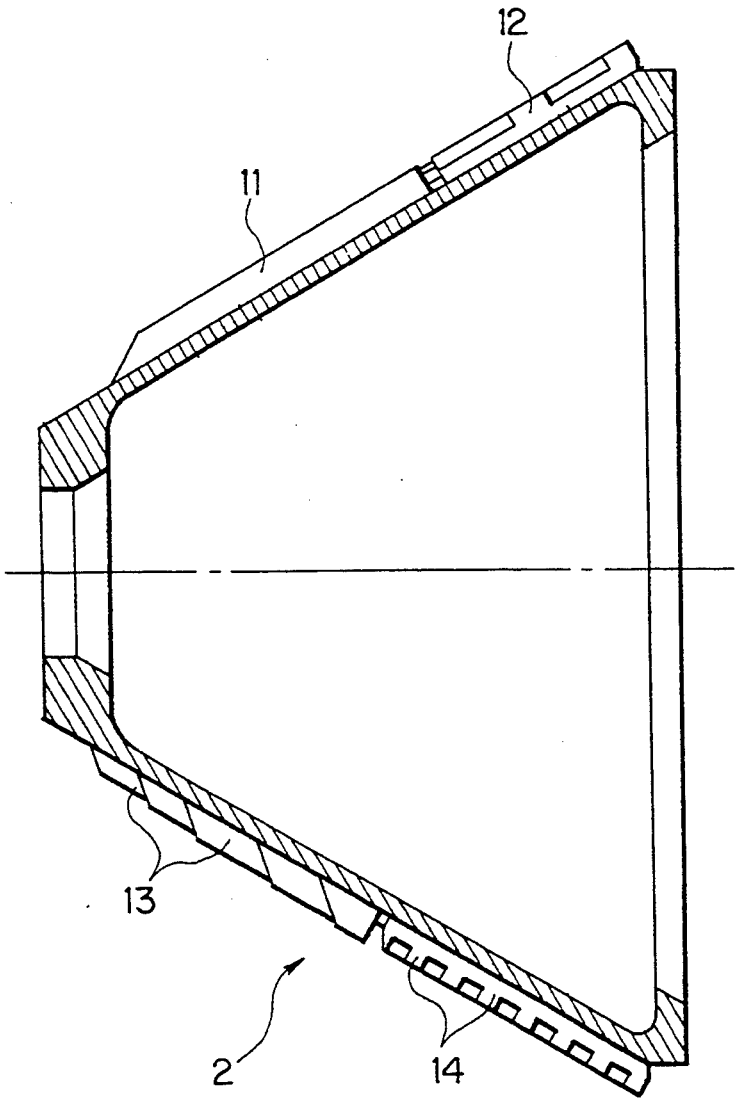

The invention is described in more detail with respect to exemplified embodiments by means of the drawings, in which:

FIG. 1 shows a front elevation of a stationary part comprising a pre-grinding and a fine grinding zone of grinding equipment according to the invention, FIG. 2 shows a shell cross-section of a stationary part along the line II—II in FIG. 1, FIG. 3 shows a partial front elevation of a rotating part comprising a grinding zone of grinding equipment according to the invention, FIG. 4 shows a cross-sectional view of the rotating part along the line IV—IV in FIG. 3, FIG. 5 shows a partial cross-sectional view of a rotating part comprising a pre-grinding and a fine grinding zone of grinding equipment according to the invention, and FIG. 6 shows a cross-sectional view of the rotating part along the line VI—VI in FIG. 5.

The inventive grinding equipment of a Jordan refiner consists of a stationary part 1 formed as a hollow truncated cone and a driven, rotating part 2 formed as a truncated cone arranged within this, as depicted in the drawings.

The stationary part shown schematically in FIG. 1 and 2 has an inner conical, ring-shaped pre-grinding zone 3 and an outer conical, ring-shaped fine grinding zone 4.

Bar-shaped knives 5 are provided in the pre-grinding zone 3 in conical ring segments arranged parallel to one another. The knives 5 are preferably steel knives and welded onto a casting 6. The surface component or area of the bar-shaped knives in the pre-grinding zone 3 amounts to at most 25 to 30%, so that 70 to 75% of the surface remains for the open areas between the knives 5. One knife 5 per conical ring segment is led entirely to the inside.

The depth of the channels between the bar-shaped knives 5 in the pre-grinding zone 3 preferably amounts to approximately 20 mm. The average knife angle of the knives 5 with respect to the conical shell generating lines amounts to approximately 12° in the pre-grinding zone 3.

Equally, the fine grinding zone 4 joining with the pre-grinding zone 3 of the stationary part 1 has bar-shaped knives 7 arranged parallel to one another. These knives 7 are preferably formed on inserted hard, high-quality grinding segments in the fine grinding zone 4. The surface component or area of the knives 7 in the fine grinding zone 4 amounts to approximately 50%.

The depth of the channels between the bar-shaped knives 7 of the fine grinding zone 4 amounts to approximately 12 mm. The average knife angle of the knives 7 with respect to the conical shell generating lines amounts to approximately 30° in the fine grinding zone 4.

The relatively small knife angle in the pre-grinding zone 3 results in the material being cut more at this point and lumps being knocked open. The relatively larger knife angle in the fine grinding zone 4 results in the grinding stock being rubbed more and treated more gently. The largest applied pressure in the rotating part 2 inserted in the stationary part 1 arises in the region of the relatively gentle pre-grinding zone 3. Behind the pre-grinding zone 3 and the fine grinding zone 4, one or more additional fine grinding zones with a further, different configuration and arrangement of the appropriate bar-shaped knives not shown can also be provided.

In FIGS. 3 and 4, a first exemplified embodiment of the rotating part 2 of the inventive grinding equipment is schematically depicted. The rotating part 2 has a single continuous grinding zone 8.

Bar-shaped knives 9 arranged parallel to one another on conical ring segments are provided in the grinding zone 8. These knives 9 are preferably formed as steel knives welded onto a casting 10. The surface component or area of the bar-shaped knives 9 in the grinding zone 8 of the rotating part 2 amounts to approximately 40% so that an open area of approximately 60% remains.

The depth of the channels between the bar-shaped knives 9 of the rotating part 2 preferably amounts to approximately 20 mm. The average knife angle of the knives 9 of the rotating part 2 with respect to the conical shell generating lines amounts to approximately 8° in the region of the pre-grinding zone 3 of the stationary part and to approximately 10° in the region of the fine grinding zone 4 of the stationary part. The reason for the average knife angle being somewhat larger in the fine grinding zone 4 of the stationary part 1 lies in that several additional small knives 9 are provided on the outside.

In this arrangement of the grinding zone 8 of the rotating part 2, an average angle of approximately 20° results between the knives 5 of the stationary part 1 in the pre-grinding zone 3 and the knives 9 of the rotating part 2, while the average angle between the knives 7 of the stationary part 1 in the fine grinding zone 4 and the knives 9 of the rotating part 2 amounts to approximately 40°.

A further exemplified embodiment of the rotating part 2 of the inventive grinding equipment is schematically depicted in FIGS. 5 and 6. Here, the truncated cone-shaped rotating part 2 has an inner conical, ring-shaped pre-grinding zone 11 and an outer conical, ring-shaped fine grinding zone 12 in which the configuration and the arrangement of bar-shaped knives 13 in the pre-grinding zone 11 and bar-shaped knives 14 in the fine grinding zone 12 differ from one another. The knives 13 of the pre-grinding zone 11 of the rotating part 2 are again arranged parallel to one another in conical ring segments. Preferably, the knives 13 of the pre-grinding zone 11 of the rotating part 2 are formed as steel knives welded onto a casting 15.

The configuration and arrangement of the bar-shaped knives 13 in the pre-grinding zone 11 of the rotating part 2 corresponds to the configuration and arrangement of the bar-shaped knives 9 in the single grinding zone 8 of the rotating part 2 as described in connection with FIGS. 3 and 4.

The bar-shaped knives 14 of the fine grinding zone 12 of the rotating part 2 are preferably also formed here on hardened grinding segments inserted in the fine grinding zone 12 of the rotating part 2.

The conical opening angle of the stationary part 1 and the rotating part 2 amounts to approximately 60°.

What is claimed is:

1. Grinding equipment of a Jordan refiner for grinding paper pulp, comprising:

a rotating part formed as a truncated cone having an outer shell surface and a plurality of bar-shaped knives secured thereon at predetermined angles to a conical shell generating line, and a stationary part formed as a hollow truncated cone having an inner shell surface and a plurality of bar-shaped knives secured thereon at predetermined angles to a conical shell generating line, wherein the stationary part has an inner conical pre-grinding zone and at least one outer conical fine grinding zone in which the configuration and arrangement of the bar-shaped knives in the pre-grinding zone and in the fine grinding zone substantially differ from one another, wherein the bar-shaped knives in the pre-grinding zone and the fine grinding zone extend linearly in a planar layout and at least in the stationary part, the average knife angle to the conical shell generating line in the pre-grinding zone amounts to at least approximately 10° and in the fine grinding zone to at least approximately 20°, wherein the bar-shaped knives on the stationary part have a surface area in the pre-grinding zone which amounts to at most, 25 to 30% of a total shell surface and approximately 50% of a total shell surface in the fine grinding zone, and wherein the depth of the channels between the bar-shaped knives in the pre-grinding zone is substantially greater than the depth of the channels between the bar-shaped knives in the fine grinding zone.

2. Grinding equipment according to claim 1, wherein the depth of the channels between the bar-shaped knives in the pre-grinding zone amounts to approximately 20 mm and to approximately 12 mm in the fine grinding zone.

3. Grinding equipment according to claim 1, wherein the average knife angle with respect to the conical shell generating line in the pre-grinding zone amounts to approximately 12° and to approximately 30° in the fine grinding zone.

4. Grinding equipment according to claim 1, wherein the stationary part is formed with steel knives welded on in the pre-grinding zone and hard grinding segments in the fine grinding zone.

5. Grinding equipment according to claim 1, wherein the surface area of the bar-shaped knives of the rotating part in the grinding zone amounts to approximately 40% of a total shell surface.

6. Grinding equipment according to claim 5, wherein the surface area of the bar-shaped knives of the rotating part in the grinding zone amounts to approximately 40% of a total shell surface.

7. Grinding equipment according to claim 6, wherein the depth of the channels between the bar-shaped knives of the rotating part amounts to approximately 20 mm.

8. Grinding equipment according to claim 5, wherein the average knife angle of the knives of the rotating part with respect to the conical shell generating line in the region of the pre-grinding zone of the stationary part amounts to approximately 8° and in the region of the fine grinding zone of the stationary part to approximately 10°.

9. Grinding equipment according to claim 1, wherein the rotating part is formed as a casting with welded on steel knives.

10. Grinding equipment according to claim 1, wherein the rotating part has at least one inner conical pre-grinding zone and at least one downstream fine grinding zone in which the configuration and arrangement of the bar-shaped knives in the fine grinding zone substantially differ.

11. Grinding equipment according to claim 10, wherein the rotating part is formed as a casting comprising steel knives welded on in the pre-grinding zone and hardened grinding segments inserted in the fine grinding zone.

12. Grinding equipment according to claim 1, wherein the configuration and arrangement of the bar-shaped knives of the rotating part in the pre-grinding zone correspond with those of a rotating part with a continuous grinding zone.

13. Grinding equipment according to claim 1, wherein the average angle between the knives of the stationary part and of the rotating part in the pre-grinding zone amounts to approximately 20° and in the fine grinding zone to approximately 40°.

14. Grinding equipment according to claim 1, wherein a conical opening angle amounts to approximately 60°.

* * * * *